United States Patent [19]

Wisdom

[11] Patent Number: 4,556,037

[45] Date of Patent: Dec. 3, 1985

[54] APPARATUS FOR THE UNIFORM DISTRIBUTION OF FUEL TO A MULTI CYLINDER SPARK IGNITION ENGINE

[75] Inventor: James R. Wisdom, Manchester, England

[73] Assignee: Shirley A. Wisdom, New South Wales, Australia

[21] Appl. No.: 694,385

[22] PCT Filed: May 17, 1984

[86] PCT No.: PCT/AU84/00086

§ 371 Date: Jan. 18, 1985

§ 102(e) Date: Jan. 18, 1985

[87] PCT Pub. No.: WO84/04568

PCT Pub. Date: Nov. 22, 1984

[30] Foreign Application Priority Data

May 18, 1983 [AU] Australia ..... PF9422

[51] Int. Cl.[4] ..... F02B 3/00

[52] U.S. Cl. ..... 123/531; 123/472; 123/451; 123/533

[58] Field of Search ..... 123/451, 448, 531, 533, 123/534, 472, 585

[56] References Cited

U.S. PATENT DOCUMENTS

| | | | |
|---|---|---|---|
| 2,262,181 | 11/1941 | Hover | 123/531 |
| 3,610,213 | 10/1971 | Gianini | 123/531 |
| 3,665,949 | 5/1972 | Rivard | 123/531 |
| 3,744,465 | 7/1973 | Voss | 123/451 |
| 3,971,351 | 7/1976 | McKee | 123/531 |
| 4,224,904 | 9/1980 | Clerk | 123/531 |
| 4,462,760 | 7/1984 | Sarich | 123/531 |

*Primary Examiner*—Ronald B. Cox

[57] ABSTRACT

The present invention consists in apparatus for the uniform distribution of fuel to a multi-cylinder spark ignition engine comprising a fuel metering device arranged to deliver discrete metered quantities of fuel in accordance with the requirments of the cylinders of the engine, means defining a catchment chamber arranged to receive each such quantity, a plurality of passages extending from said chamber, one for each cylinder of the engine, each said passage being connected through a conduit to the induction passage of one cylinder, means for admitting gas under pressure to said passages to expel each quantity of fuel from the chamber and means for directing the flow of gas from said chamber along each of said passages in turn whereby a metered quantity of fuel is delivered to each cylinder in turn.

5 Claims, 6 Drawing Figures

APPARATUS FOR THE UNIFORM DISTRIBUTION OF FUEL TO A MULTI CYLINDER SPARK IGNITION ENGINE

The invention relates to apparatus for the distribution of measured quantities of liquid fuel into the induction tracts of a multi-cylinder spark ignition internal combustion engine.

BACKGROUND ART

Many apparatus for injecting fuel to an internal combustion engine have been devised and most rely on the maintenance of a column of liquid at high pressure to prevent the vaporisation of fuel under hot operating conditions, up to the point of the discharge of the fuel via a suitable nozzle.

Both continuously flowing and interrupted timed injection principles of operation are utilised. In both cases high precision components with matched calibrated flow characteristics are utilized one for each cylinder to achieve equal fuel distribution to each cylinder of the internal combustion engine.

It has been proposed to use a system known as the throttle body injection in which a single injector is used to inject the fuel into a manifold through which it travels to the cylinders in the same way as does the charge of fuel from a conventional carburetter. While this arrangement involves only a single or in the case of a V8 engine to injectors its does not achieve the accuracy of fuel delivery of an arrangement in which fuel is delivered directly to the inlet port of each cylinder in turn.

DISCLOSURE OF THE INVENTION

The object of the present invention is to provide apparatus for distributing the fuel equally after the required quantity has been metered by any suitable single means, and delivering it directly to the inlet port of each cylinder in turn thereby reducing the need for the use of a multiplicity of high precision expensively calibrated components.

The present invention consists in apparatus for the uniform distribution of fuel to a multi-cylinder spark ignition engine comprising a fuel metering device arranged to deliver discrete metered quantities of fuel in accordance with the requirements of the cylinders of the engine, means defining a catchment chamber arranged to receive each such quantity, a plurality of passages extending from said chamber, one for each cylinder of the engine, each said passage being connected through a conduit to the induction passage of one cylinder, means for admitting gas under pressure to said passages to expel each quantity of fuel from the chamber and means for directing the flow of gas from said chamber along each of said passages in turn whereby a metered quantity of fuel is delivered to each cylinder in turn.

BRIEF DESCRIPTION OF DRAWINGS

In order that the invention may be better understood preferred forms thereof are hereinafter described by way of example with reference to the accompanying drawings in which:

FIG. 1 shows one cylinder 10 of a multi-cylinder engine having an inlet manifold 11. An injection nozzle 12 extends into the manifold 11 and this is connected by a conduit 13 to a passage 14 within the body 15 of apparatus according to the invention. As is explained in greater detail in connection with the embodiments described below there is a conduit 13, injection nozzle 12 and a passage 14 corresponding to each of the cylinders of the engine. These passages meet in a catchment chamber 16 which is arranged immediately below a fuel metering device 17. This is of conventional construction and is arranged to inject into the catchment chamber a series of discrete quantities of fuel which is measured out by the fuel metering device 17 in accordance with the instantaneous requirements of the engine in a well known manner.

A solenoid controlled valve 18 controls the admission of gas under pressure from a compressor or other source (not shown) into a passage 19 of the body 15, the function of which is described below. The operation of the solenoid controlled valves is governed by the timing means (not shown) as explained below.

Figure 1:
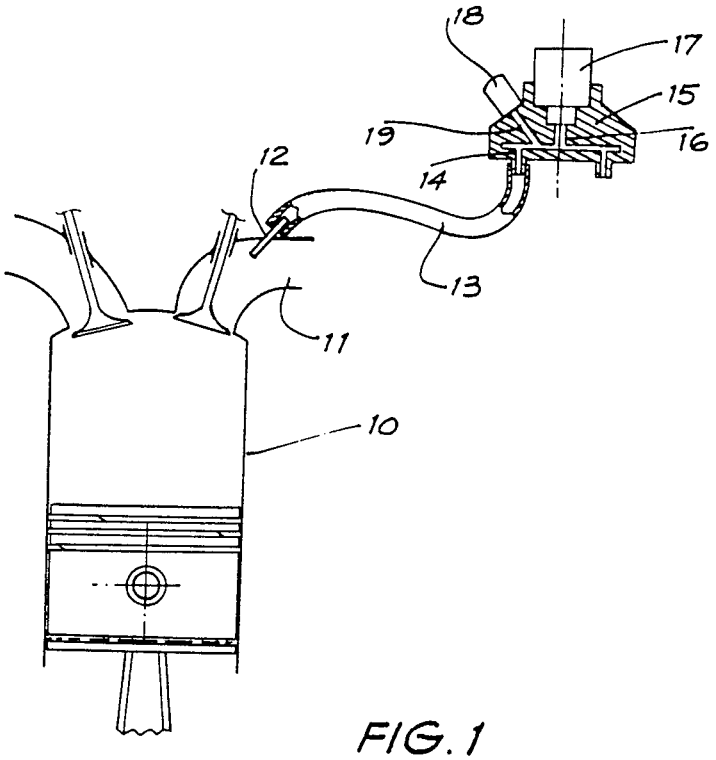
FIG. 1 is a diagrammatic view of the essential parts of apparatus according to the invention as applied to a single cylinder of a multi-cylinder engine.
Figure 2:
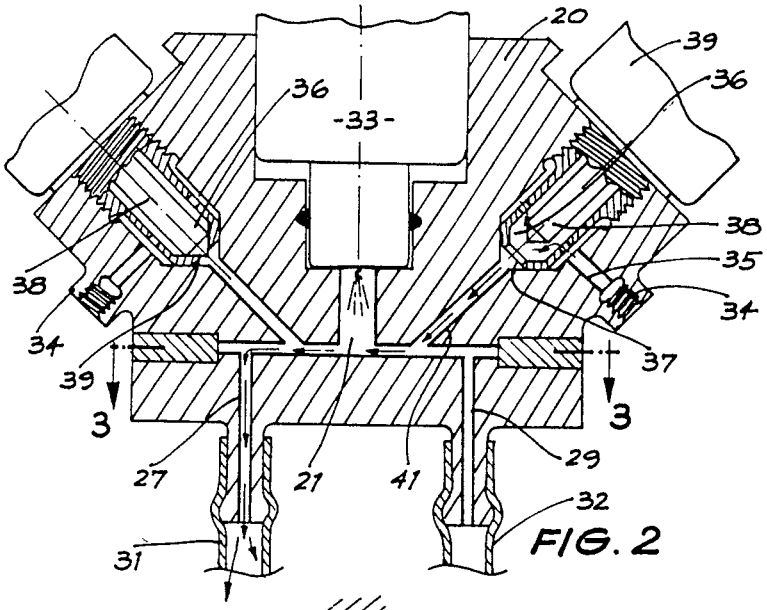
FIG. 2 is a cross-sectional elevation of the essential parts of a first form of the invention.
Figure 3:
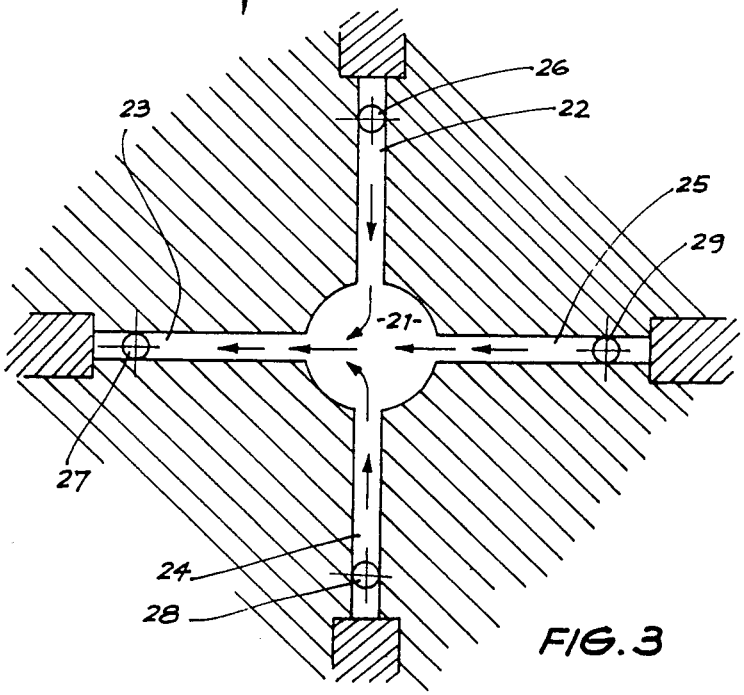
FIG. 3 is a section on line 3—3 of FIG. 2.

The embodiment illustrated in FIGS. 2 and 3 is similar in its general arrangement to the apparatus shown diagrammatically in FIG. 1. In this construction there is provided in the body of the apparatus a fuel catchment chamber 21 from the bottom of which passages 22, 23, 24 and 25 radiate outwards and connect with passages 26, 27, 28 and 29 respectively. These latter passages are connected to conduits such as 31 and 32 which each lead to one of the cylinders of the engine and correspond to the conduit 13 of FIG. 1.

A fuel metering device 33 is arranged in the body 20 of the apparatus above the chamber 21. The fuel metering device 33 is of conventional construction and may be, for example, that manufactured by General Motors and sold under the designation of throttle body injector. It is arranged to deliver discrete quantities of fuel in an intermittent pulsed fashion at a frequency in accordance with engine speed or at a higher or lower rate depending upon operational requirements, into the catchment chamber 21 arranged immediately below. Each quantity of fuel delivered to the catchment chamber is thereafter transferred to the appropriate one of passages 26, 27, 28 and 29 and thence to the appropriate cyclinder via a conduit such as 31 or 32 by means of pressure exerted by air or other gas.

Each of the connectors 34 on the body is connected to a source of air or other gas under pressure, the pressure being derived from a compressor or any other suitable source. In each case air or other gas under pressure passes via the passage 35 to a valve chamber 36 the outlet 37 from which is controlled by the valve member 38 which is operated by means of the electromagnetic solenoid 39. In FIG. 2 the outlet from the right hand valve chamber 36 is shown as open thus permitting air to flow via the passage 41 into the passage 25. The outlet from the left hand valve chamber 36 is however shown as closed. The chambers 36 of the two units arranged in a plane at right angles to the plane of the section and thus not seen in FIG. 2 are both open.

The result of this arrangement is shown in FIG. 3 by means of the arrows indicating the direction of movement of air which is shown as flowing inwardly along passages 22, 24 and 25 and outwardly along passage 23. The effect of this is that a quantity of fuel in the catchment chamber 21 is propelled along passage 23 down passage 27 to a conduit associated with one of the four cylinders of the engine.

During operation of the engine the solenoids 39 are controlled in accordance with the firing order of the engine cylinders by a timing means of conventional nature which may be associated with the operation of the fuel metering device (for example, an electronic sequencer may be used to send a pulse to each solenoid in turn at a predetermined interval after each energisation of the fuel metering device) 33 so that the charge of fuel is sent along one of the passages 22, 23, 24 or 25 to each cylinder in accordance with the requirements of the cylinders. It has been found that the best way of operating the apparatus is to maintain all the air valves normally open and to close the valve associated with the cylinder to which a charge of fuel is to be supplied. The effect of this is to cut off the gas flow from one direction thus permitting the movement of fuel in the opposite direction. It will be appreciated that the opening and closing of the valves takes place very quickly and that there will in effect always be an outlet for air along one of the passages 22, 23, 24 and 25.

As will be readily understood the great advantage of the apparatus described is that only one metering device is required for all the cylinders in contrast to known arrangements which involve the use of a separate metering device for each cylinder.

Figure 4:
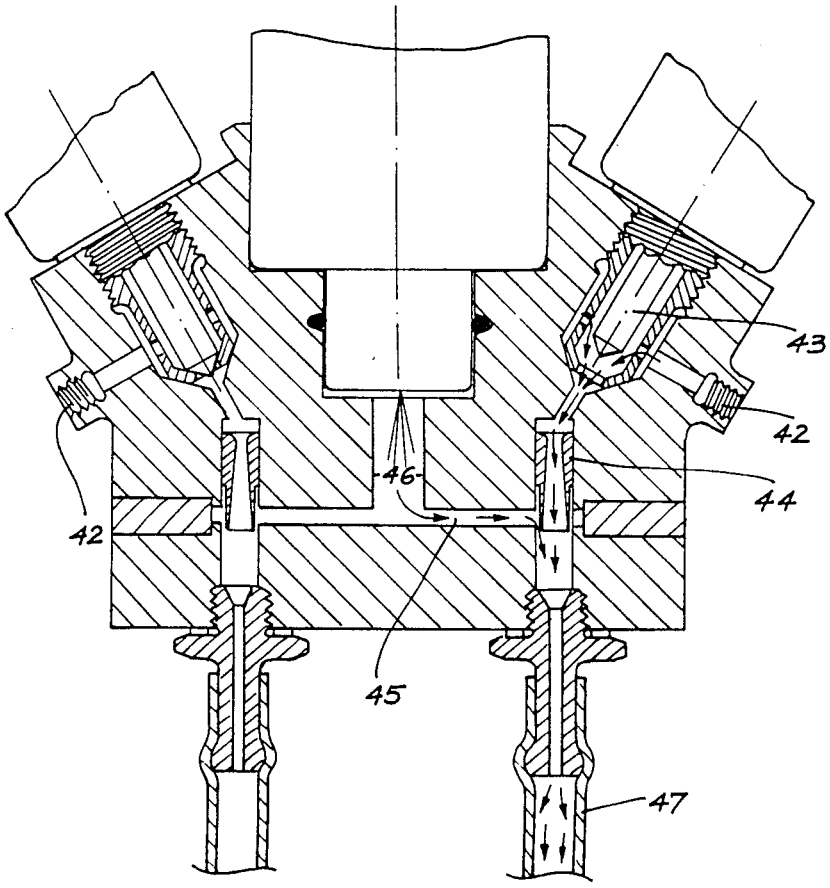
FIG. 4 is a view similar to that of FIG. 2 of a second embodiment of the invention.

In a second embodiment of the invention shown in FIG. 4 the apparatus works in substantially the same way as that described in connection with FIGS. 1 and 2 and it will therefore be described only insofar as it differs from that construction. In the construction of FIG. 4 air is admitted through connections 42 and the flow of air is controlled by solenoid actuated valves 43. When a valve 43 is open air passes to the upstream of a nozzle 44. The rate of flow and the pressure of the air is sufficient to produce sonic velocity flow conditions at the throat of the nozzle 44 the profile of which, downstream of the throat is such that under these conditions supersonic velocities are produced in this region. The resultant low static pressure associated with these conditions causes a depression to occur in the passage 45 and fuel from the chamber 46 is induced to flow in the direction of the arrows to conduit 47. It has been found experimentally that using a gas entry pressure of 450 Kpa abs at the nozzle produces a depression of 10 Kpa within the passage 45.

In this embodiment of the invention the valve 43 corresponding to the cylinder to which fuel is to be supplied is open the other valves being closed.

Figure 5:
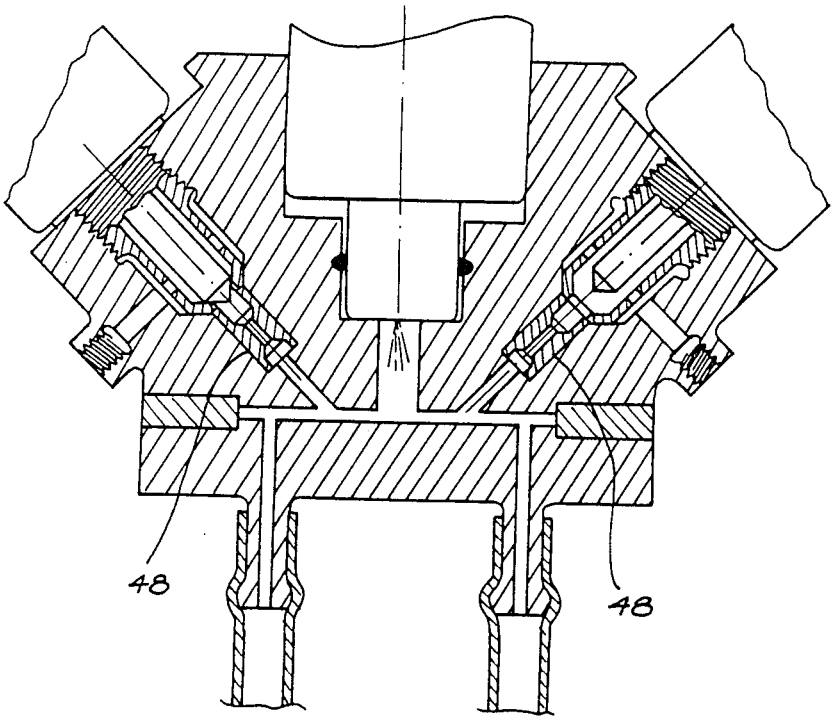
FIG. 5 is a view similar to that of FIG. 2 of a third embodiment of the invention.
Figure 6:
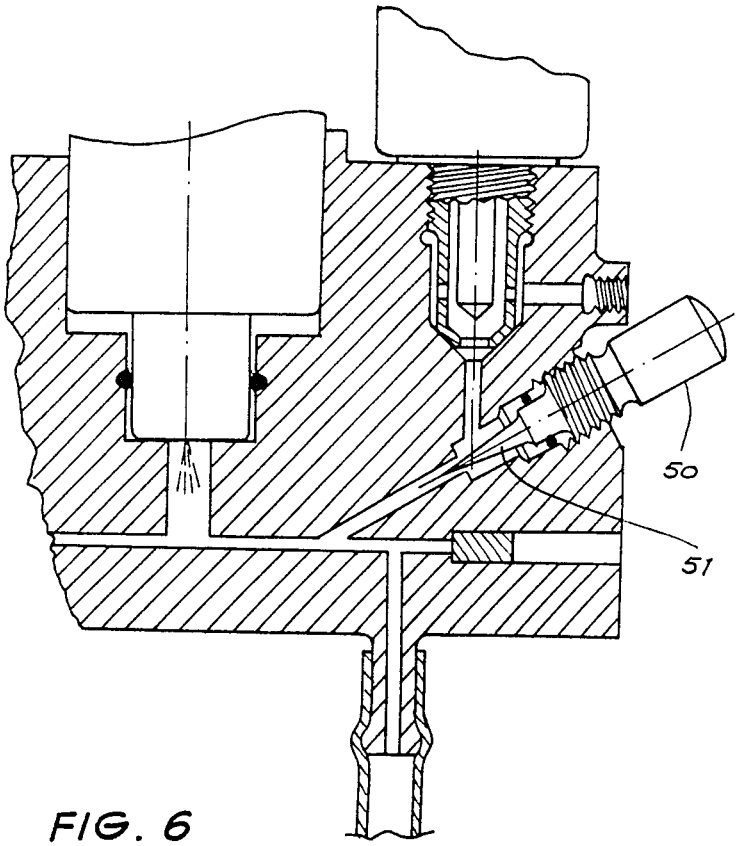
FIG. 6 is a partial sectional view of a fourth embodiment of the invention.

In order to obtain equal distribution of fuel between passages 22, 23, 24 and 25 of FIG. 1 it is necessary that each air passage should have similar air flow characteristics. For this purpose it is necessary to control the area of the passage either by a manufacturing process of high accuracy or the introduction of flow control sections. Two methods of achieving the required characteristics are shown in FIGS. 5 and 6. In FIG. 5 the required area of the control section is obtained by introduction of a separately calibrated jet orifice 48 in each air passage downstream of the air solenoid valves. The air flow characteristics of each air jet is determined before being inserted into the air passage, the jets being made so that the performance of all jets has a high degree of similarity.

The second method shown in FIG. 6 relies on the use of a screw threaded unit having a tapered end 50. The unit has a tapered portion 51 the actual position of which within the air passage controls the air flow characteristics and thus adjustments can be made to enable equal distribution of fuel to each cylinder. With both the arrangements described above it is possible, if desired, to arrange for a differential distribution of fuel between cylinders.

The embodiments of the invention described above are given by way of example only and as illustrating ways in which the invention defined broadly in the succeeding claims can be applied.

I claim:

1. The present invention consists in apparatus for the uniform distribution of fuel to a multi-cylinder spark ignition engine comprising a fuel metering device arranged to deliver discrete metered quantities of fuel in accordance with the requirements of the cylinders of the engine, means defining a catchment chamber arranged to receive each such quantity, a plurality of passages extending from said chamber, one for each cylinder of the engine, each said passage being connected through a conduit to the induction passage of one cylinder, means for admitting gas under pressure to said passages to expel each quantity of fuel from the chamber and means for directing the flow of gas from said chamber along each of said passages in turn whereby a metered quantity of fuel is delivered to each cylinder in turn.

2. Apparatus as claimed in claim 1 wherein the means for admitting gas under pressure to the said passages consists in a plurality of solenoid controlled valves, one for each passage, each valve being connected to a source of gas under pressure, timing means for causing the valves to open in turn and in such a manner that a flow of gas is directed along each passage in turn towards the cylinder to which the passage connects.

3. Apparatus as claimed in claim 2 wherein the fuel metering device is arranged immediately above the catchment chamber and the passages radiate from the bottom of that chamber, the solenoid controlled valves being connected to the passages in such a manner that when the solenoid valve associated with one of said passages is closed gas enters the catchment chamber from all other solenoid controlled valves to expel a metered quantity of fuel from the chamber along the said one passage.

4. Apparatus as claimed in claim 3 wherein means are provided in association with each solenoid controlled valve whereby the air flow characteristics of each passage can be controlled.

5. Apparatus as claimed in claim 2 wherein the means for admitting gas under pressure to the said passages consists in a plurality of solenoid controlled valves, one for each passage, each valve being connected to a source of gas under pressure, timing means for causing the valves to open in turn, gas flowing from any open valve being directed through means arranged to produce a negative pressure in the passage associated with that valve whereby a metered quantity of fuel from the catchment chamber is caused to pass along that passage to the cylinder associated therewith.

* * * * *